US009359046B2

(12) United States Patent
Rosche

(10) Patent No.: US 9,359,046 B2
(45) Date of Patent: Jun. 7, 2016

(54) SUBMERSIBLE TOWED BODY DEPLOYMENT AND RECOVERY DEVICE

(71) Applicant: Raytheon Company, Waltham, MA (US)

(72) Inventor: Gregory S. Rosche, Waltham, MA (US)

(73) Assignee: Raytheon Company, Waltham, MA (US)

( * ) Notice: Subject to any disclaimer, the term of this patent is extended or adjusted under 35 U.S.C. 154(b) by 71 days.

(21) Appl. No.: 14/044,746

(22) Filed: Oct. 2, 2013

(65) Prior Publication Data

US 2015/0093218 A1 Apr. 2, 2015

(51) Int. Cl.

| | |
|---|---|
| ***B63B 21/66*** | (2006.01) |
| ***B63B 35/40*** | (2006.01) |
| ***B63B 23/30*** | (2006.01) |
| ***B63B 23/32*** | (2006.01) |

(Continued)

(52) U.S. Cl.

CPC ..... *B63B 21/66* (2013.01); *B63B 21/56* (2013.01); *B63B 23/32* (2013.01); *B63B 27/143* (2013.01); *B63B 27/36* (2013.01); *B63C 3/02* (2013.01); *B63B 2027/165* (2013.01)

(58) Field of Classification Search

CPC .. B63B 27/36; B63B 21/66; B63B 2027/165; B63B 2035/006; B63B 21/56; B63B 21/58; B63B 23/32; B63B 27/143; B63B 35/003; B60P 3/1058; B63C 3/02; B63C 11/42; B63C 1/02; B63C 2011/028; B63C 3/08

USPC ..... 114/258, 322, 343, 375, 48, 51; 212/308; 254/900; 405/188, 191, 2, 7; 414/137.7, 139.6, 462, 477, 538, 678

See application file for complete search history.

(56) References Cited

U.S. PATENT DOCUMENTS 2,485,793 A * 10/1949 Vassar ..... 414/477
2,821,315 A * 1/1958 Bucher ..... 414/477

(Continued)

FOREIGN PATENT DOCUMENTS

DE 4140201 A1 * 6/1993 ..... B63B 21/66
DE 19500182 A1 * 7/1996 ..... B63B 27/36

OTHER PUBLICATIONS

Northrop Grumman; AN/AQS-24A Airborne Minehunting System; Undersea Systems Data Sheet; upon knowledge and belief prior to Nov. 2012; 2 pages; Northrop Grumman.

(Continued)

*Primary Examiner* — Gregory Adams

(57) ABSTRACT

A submersible towed body deployment and recovery device is disclosed. The device can include a support structure supportable by a surface watercraft, and configured for rotational and translational movement relative to the watercraft. Additionally, the device can include a towed body interface structure supported by the support structure and configured to interface with and support a wing and a forward end of a towed body. The support structure can be movable between a deploy/recovery position in which at least a portion of the towed body interface structure extends into water about the watercraft and a stowed position in which the towed body interface structure positions the towed body out of the water. Coordinated rotational and translational movement of the support structure can utilize buoyancy of the towed body in the water to minimize loading on the deployment and recovery device when moving between the deploy/recovery position and the stowed position.

20 Claims, 7 Drawing Sheets

(51) Int. Cl.

| | |
|---|---|
| ***B63B 27/14*** | (2006.01) |
| ***B63C 3/02*** | (2006.01) |
| ***B63B 21/56*** | (2006.01) |
| ***B63B 27/36*** | (2006.01) |
| *B63B 27/16* | (2006.01) |

(56) References Cited

U.S. PATENT DOCUMENTS

| | | | | |
|---|---|---|---|---|
| 2,827,188 | A * | 3/1958 | Reeder | 414/478 |
| 3,303,945 | A * | 2/1967 | Hubbard et al. | 414/137.7 |
| 3,993,011 | A * | 11/1976 | Garland | 414/137.7 |
| 4,876,979 | A * | 10/1989 | Walton et al. | 114/258 |
| 5,184,913 | A * | 2/1993 | Meriwether | 405/1 |
| 5,234,285 | A * | 8/1993 | Cameron | 405/2 |
| 5,995,882 | A * | 11/1999 | Patterson et al. | 701/21 |
| 6,923,598 | B2 * | 8/2005 | Vatsvåg | 405/203 |
| 7,699,015 | B1 * | 4/2010 | Said | 114/253 |
| 7,712,429 | B1 * | 5/2010 | Gibson et al. | 114/312 |
| 8,221,028 | B2 * | 7/2012 | Smith | 405/3 |
| 2002/0078876 | A1 * | 6/2002 | Ockels | 114/344 |
| 2009/0308299 | A1 * | 12/2009 | Luccioni et al. | 114/230.23 |
| 2010/0275831 | A1 * | 11/2010 | Stottlemyer et al. | 114/254 |
| 2012/0192780 | A1 * | 8/2012 | Soreau et al. | 114/259 |

OTHER PUBLICATIONS

Northrop Grumman; AN/AQS 24A Airborne Minehunting System; https://web.archive.org/web/20130627025309/http://www.northropgrumman.com/Capabilities/ANAQS24A/Pages/default.aspx ; archived online Jun. 27, 2013, 1 page; Northrop Grumman Corporation.

Northrop Grumman; Northrop Grumman to Support U.S. Navy on Minehunting Integration; News Release; Jun. 10, 2013; 1 page; PRNewswire.

Program Executive Office for Littoral Combat Ships; Testing the AN/AQS-20A Mine Reconnaissance Sonar System in the NSWC PCD Testing Range, 2012-2014; Overseas Environmental Assessment; Jan. 2012; 52 pages; Department of the Navy.

* cited by examiner

SUBMERSIBLE TOWED BODY DEPLOYMENT AND RECOVERY DEVICE

BACKGROUND

Underwater naval mines are a constant threat to surface ships and submarines. Submersible towed bodies having sonar sensor arrays are often used to identify naval mines. A submersible towed body is typically towed by a tow platform, such as a surface watercraft. One such watercraft is a remotely controlled unmanned surface vehicle (USV). The USV typically carries a towed body aboard the USV to a desired location and then deploys the towed body into the water. The USV then tows the towed body in search of naval mines. Once a mission is completed, the USV retrieves the towed body from the water. Some towed bodies are towed from a "nose" tow point while others are towed from a "center" tow point. The "center" tow point presents unique challenges when deploying and retrieving the towed body. A typical apparatus for deploying and retrieving a towed body with a "center" tow point utilizes a large boom that supports the towed body via the tow line from the "center" tow point and swings the towed body up and over the top of a pivot point on the surface watercraft.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
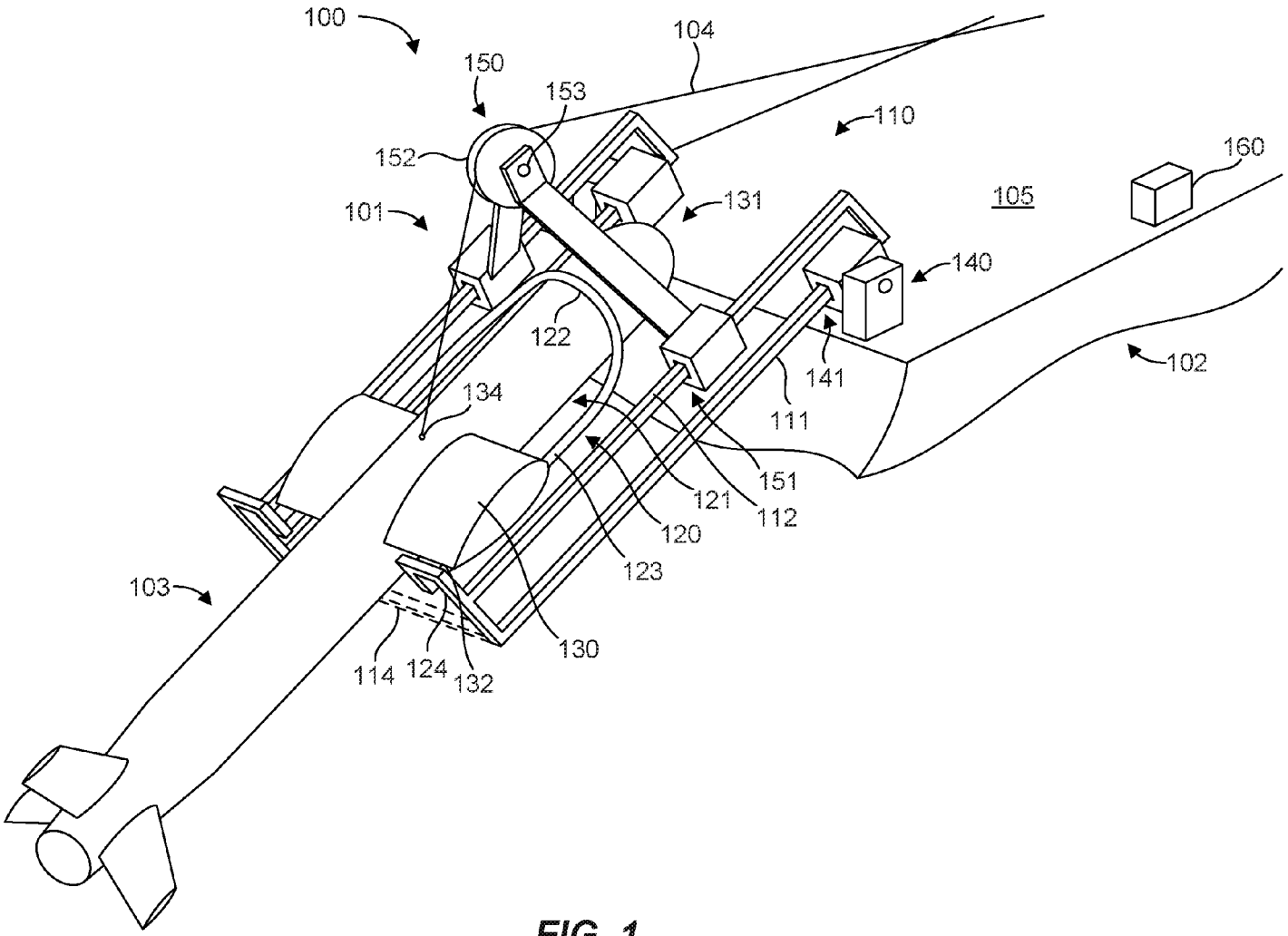
FIG. 1 is an example illustration of a submersible towed body deployment and recovery system, in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

As indicated above, submersible towed bodies having "center" tow points are typically deployed and retrieved using a large boom that swings the towed body up and over the top of a pivot point on a surface watercraft. Such designs can be bulky and heavy, due to the high load capacity needed to cantilever the boom from the watercraft and support the tow device as the boom rotates to lift the tow device from the water. A bulky and heavy apparatus can be problematic for a small surface watercraft.

Accordingly, a submersible towed body deployment and recovery device is disclosed that enables reduced size and weight compared to a typical deployment and retrieval apparatus. In one aspect, the device utilizes buoyancy of the towed body in the water to minimize loading on the deployment and recovery device when moving between a deploy/recovery position and a stowed position. The submersible towed body deployment and recovery device can include a support structure supportable by a surface watercraft, and configured for rotational and translational movement relative to the watercraft. Additionally, the device can include a towed body interface structure supported by the support structure and configured to interface with and support a wing and a forward end of a towed body. The support structure can be movable between a deploy/recovery position in which at least a portion of the towed body interface structure extends into water about the watercraft and a stowed position in which the towed body interface structure positions the towed body out of the water. Coordinated rotational and translational movement of the support structure can utilize buoyancy of the towed body in the water to minimize loading on the deployment and recovery device when moving between the deploy/recovery position and the stowed position.

A submersible towed body deployment and recovery system is also disclosed. The system can include a surface watercraft, a submersible towed body coupled to the watercraft by a tow line, and a towed body deployment and recovery device. The towed body deployment and recovery device can include a support structure supported by the watercraft, and configured for rotational and translational movement relative to the watercraft, and a towed body interface structure supported by the support structure and configured to interface with and support a wing and a forward end of the towed body. The support structure can be movable between a deploy/recovery position in which at least a portion of the towed body interface structure extends into the water about the watercraft and a stowed position in which the towed body interface structure positions the towed body out of the water. Coordinated rotational and translational movement of the support structure can utilize buoyancy of the towed body in the water to minimize loading on the deployment and recovery device when moving between the deploy/recovery position and the stowed position.

One exemplary embodiment of a submersible towed body deployment and recovery system 100 is illustrated in FIG. 1. The system 100 can comprise a submersible towed body deployment and recovery device 101, a surface watercraft 102, such as a USV, and a submersible towed body 103. In one aspect, the towed body 103 can include a sonar sensor, which can be used to locate underwater mines.

The towed body 103 can be coupled to the watercraft 102 by a tow line or tether 104. Typically, the watercraft 102 includes a winch (not shown) operable with the tow line 104 to control the distance between the watercraft 102 and the towed body 103. The winch can be used to pull the towed body 103 toward the watercraft 102 to retrieve the towed body 103 from the water. The tow line 104 is shown coupled to the towed body 103 at a "center" tow point 134, which can be on a main body portion of the towed body (as shown) or, in some embodiments, on a wing of the towed body. The "center" tow point can provide some advantages over a "nose" tow point when maneuvering the towed body 103 in the water, however, the "center" tow point presents some difficulties when retrieving the towed body that are not encountered when retrieving a towed body with a "nose" tow point. For example, a towed body with a "center" tow point is not easily "dragged" up a ramp for retrieval, as is typical with towed bodies having a "nose" tow point. Accordingly, towed bodies having "center" tow points are generally hoisted out of the water by a boom swung forward, which typically involves a heavy and bulky apparatus to safely handle the loads involved in such a retrieval technique. As shown and described herein, the towed body deployment and recovery device 101 is designed to operate in a different manner, which subjects the towed body deployment and recovery device 101 to lower loads therefore reducing the weight and size of the device 101 compared to other "center" tow point deployment and retrieval devices.

The tow line 104 can include a cable configured to physically tow the towed body 103 behind the watercraft 102. In one aspect, the tow line 104 can include one or more communication lines, such as fiber optic lines. Each of the communication lines can comprise a single line or a bundle of lines. In a particular aspect, the cable can be configured as a sheath that can shield the communication lines from physical damage. For example, the sheath can comprise a hollow core of braided material and the communication lines can be disposed at a center of the hollow core. The sheath can be configured to withstand axial loads placed on the tow line 104 so that the communication lines can remain substantially unstressed by the axial loads. In this way, the communication lines can be protected from mechanical damage by being disposed inside the sheath. Thus, the sheath can safeguard the communication lines through deployment and mission life of the towed body 103.

The towed body deployment and recovery device 101 can include a support structure 110 supported by the watercraft 102. The support structure 110 can be configured to be secured to a part of the watercraft 102, such as a deck 105, a railing, or other suitable feature of the watercraft 102. The support structure 110 can be readily adapted to interface with any platform and can therefore be installed on any suitable watercraft. As described herein, the support structure 110 can include any brace, strut, rail, or other suitable support. For example, in some embodiments, the support structure 110 can include a cross brace 114 extending between lateral sides of the support structure 110 to enhance stiffness or stability of the support structure 110.

The towed body deployment and recovery device 101 can also include a towed body interface structure 120 supported by the support structure 110 and configured to interface with and support a wing 130 or other appendage and a forward end 131 of the towed body 103. For example, as shown in FIG. 1, the towed body interface structure 120 can be configured to interface with and support an underside of the wing 130 and an upper side of the forward end 131 of the towed body 103.

The support structure 110 can be configured for rotational and translational movement relative to the watercraft 102. Thus, the support structure 110 can be movable between a deploy/recovery position in which at least a portion of the towed body interface structure 120 extends into water about the watercraft 102 and a stowed position in which the towed body interface structure 120 positions the towed body 102 out of the water. In one aspect, coordinated rotational and translational movement of the support structure 110 can utilize buoyancy of the towed body 103 in the water to minimize loading on the deployment and recovery device 101 when moving between the deploy/recovery position and the stowed position. The deploy/recovery position and the stowed position are discussed in more detail hereinafter with regard to FIGS. 2A-2H.

With further reference to FIG. 1, in one aspect the towed body deployment and recovery device 101 can include an actuated pivotal joint 140 to facilitate rotational movement of the support structure 110 relative to the watercraft 102. In another aspect, the towed body deployment and recovery device 101 can include an actuated linear joint 141 to facilitate translational movement of the support structure 110 relative to the watercraft 102. In a particular aspect, the support structure 110 can include a rail 111 to facilitate translational movement of the support structure 110 relative to the watercraft 102. The rail 111 can be configured to interface with a roller, gear, teeth, bearing, or other such feature to facilitate translational movement of the support structure 110 via the actuated linear joint 141.

The towed body interface structure 120 can include an opening 121 to receive the forward end 131 of the towed body 103, such as when the support structure 110 is in the deploy/recovery position. As the support structure 110 moves from the deploy/recovery position to the stowed position, the opening 121 can facilitate movement of the forward end 131 of the towed body 103 into contact with a top support 122 of the towed body interface structure 120 as the wing 130 rotates about a wing support 123 of the towed body interface structure 120. The top support can be sized and/or shaped to fit around the forward end 131 or nose of the towed body 103.

In one aspect, the towed body interface structure 120 can include a rear extension 124 configured to interface with and support a trailing end 132 of the wing 130. In another aspect, the towed body interface structure 120 can include padding disposed about the towed body interface structure 120, such as the top support 122, the wing support 123, and/or the rear extension 124. The padding can be configured to interface with the towed body 103 to minimize damage to the towed body 103, such as to any external sensors, due to contact with the towed body interface structure 120.

The "open frame" configuration of the support structure 110 and the towed body interface structure 120 illustrated in FIG. 1 can be configured to provide low hydrodynamic drag and flow disturbance near the towed body when extended into the water. This can not only facilitate stability of the towed body 103 when near the towed body deployment and recovery device 101, but can also contribute to reduced loads on the device 101, facilitating a lighter and less bulky design. In one aspect, surfaces of the support structure 110 and/or the towed body interface structure 120 that are configured to be disposed in the water can be faired to reduce hydrodynamic drag and flow disturbance.

The towed body deployment and recovery device 101 can further include a tow line guide 150 coupled to and supported by the support structure 110. The tow line guide 150 can include a sheave 152 to interface with the tow line 104. In one aspect, the sheave 152 can be configured to rotate about a pivot 153 to facilitate movement of the tow line 104 relative to the tow line guide 150. The tow line guide 150 can be configured to translate relative to the support structure 110 to guide the tow line 104 between the watercraft 102 and the towed body 103 during movement between the deploy/recovery position and the stowed position. In one aspect, the tow line guide 150 can include an actuated linear joint 151 to facilitate translational movement of the tow line guide 150 relative to the support structure 110. In another aspect, the support structure 110 can include a rail 112 and the tow line guide 150 can be translatable relative to the support structure 110 along the rail 112. The rail 112 can be configured to interface with a roller, gear, teeth, bearing, or other such feature to facilitate translational movement of the tow line guide 150 relative to the support structure 110 via the actuated linear joint 151.

The various translational and rotational movements of the support structure 110 and the tow line guide 150 caused by the actuated pivotal joint 140, the actuated linear joint 141, and the actuated linear joint 151 can be controlled and/or coordinated by a microprocessor 160. In one aspect, the microprocessor 160 can also control operation of the winch to maintain a suitable tension on the tow line 104 during a deploy/recovery operation. For example, the microprocessor 160 can receive data regarding the direction and/or magnitude of the force in the tow line 104, the position of the tow line guide 150 on the support structure 110, the force on the sheave 152, the position of the support structure 110, and/or the force and/or moment loading on the actuated pivotal joint 140 and/or the actuated linear joint 141. In order to obtain such data, the towed body deployment and recovery device 101 can include any suitable sensor or instrumentation and can be configured to provide communication between the sensors and the microprocessor 160, as well as communication between the microprocessor 160 and the various actuators involved. The microprocessor 160 can therefore facilitate coordinated control of the towed body deployment and recovery device 101 to minimize loading on the deployment and recovery device 101 when moving between the deploy/recovery position and the stowed position. In one aspect, a deployment/recovery operation of the towed body 103 can be automated.

FIGS. 2A-2H illustrate the towed body deployment and recovery device 101 in use. For example, in FIG. 2A, the towed body deployment and recovery device 101 is shown with the support structure 110 retracted in the stowed position where the support structure 110 is substantially disposed over the watercraft 102. In this position, the tow line guide 150 can be moved to a rearward end 115 of the support structure 110, as shown, when the towed body 103 is deployed. This can facilitate towing the towed body 103 without interference of the tow line 104 with the support structure 110 and/or the towed body interface structure 120, which may be more likely to occur if the tow line guide 150 is positioned toward a forward end 116 of the support structure 110. This position of the tow line guide 150 is also proximate the attachment location of the support structure 110 to the watercraft 102, which can provide a suitably stiff support for the tow line guide 150 when subjected to the high tension loads in the tow line 104 when towing the towed body 103 behind the watercraft 102.

Figure 2A:
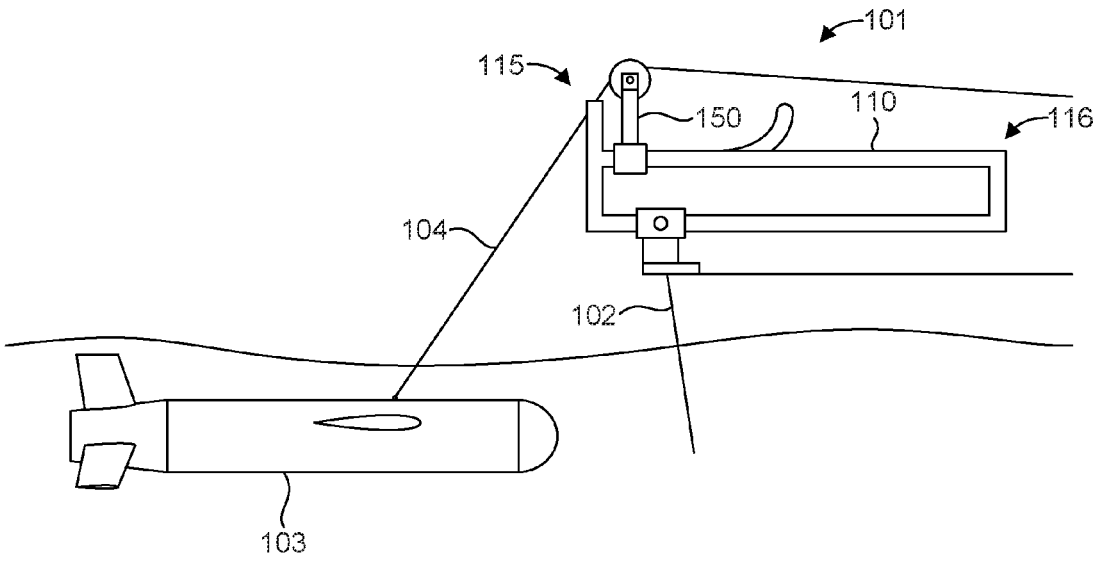
FIGS. 2A-2H illustrate a submersible towed body deployment and recovery system in use, in accordance with an embodiment of the present invention.
Figure 2B:
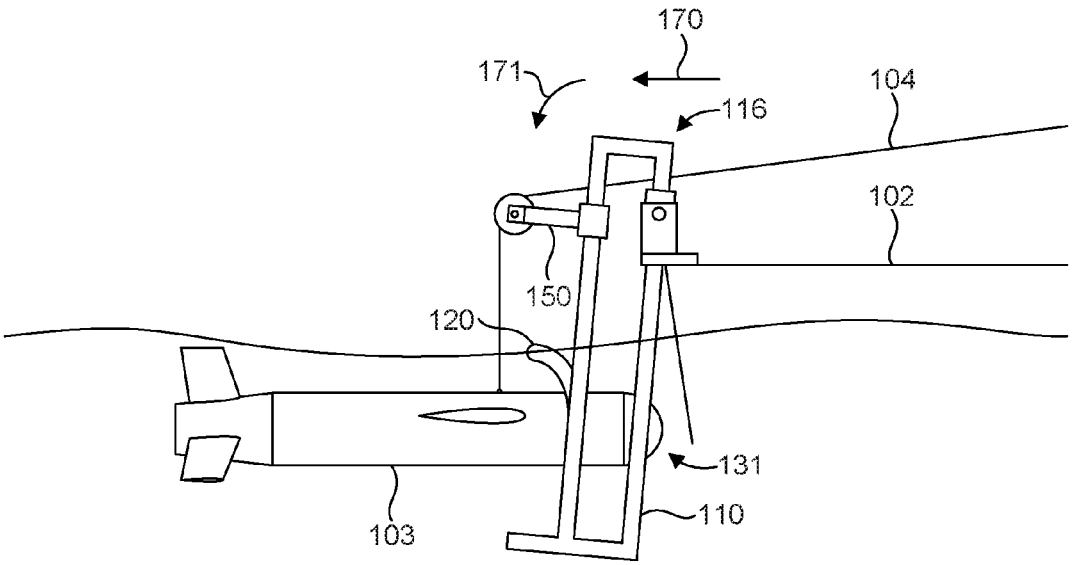

In order to recover the towed body 103 from the water, the watercraft 102 can slow to a suitable speed and move the support structure 110 from the stowed position to the deploy/recovery position, as shown in FIG. 2B, such as by translating the support structure 110 rearward in direction 170 and rotating in direction 171. In addition, the tow line guide 150 can move toward the forward end 116 of the support structure 110 to prevent the tow line guide 150 from entering the water as well as preventing interference between the tow line 104 and the watercraft 102. In this position, the forward end 131 of the towed body 103 can pass through the opening in the towed body interface structure 120. The padding on the towed body interface structure 120 can prevent damage to the towed body 103 as the towed body interfaces with the towed body interface structure 120 throughout the recovery operation.

Figure 2C:
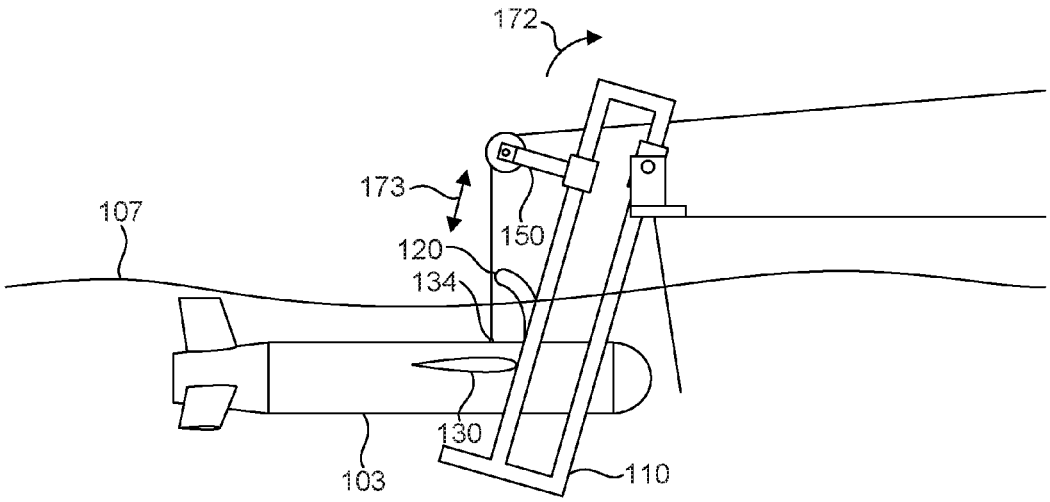
Figure 2D:
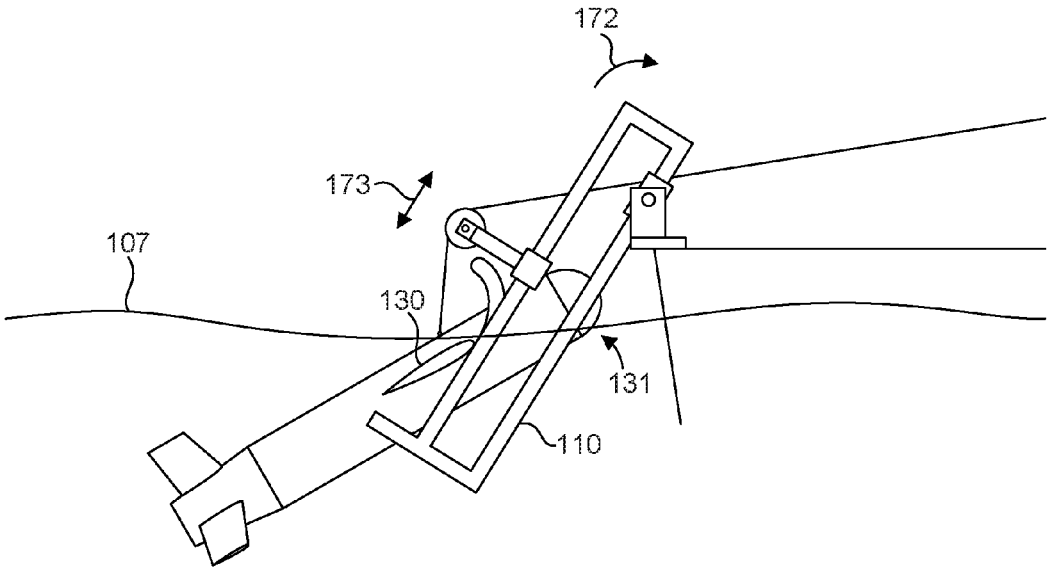
Figure 2E:
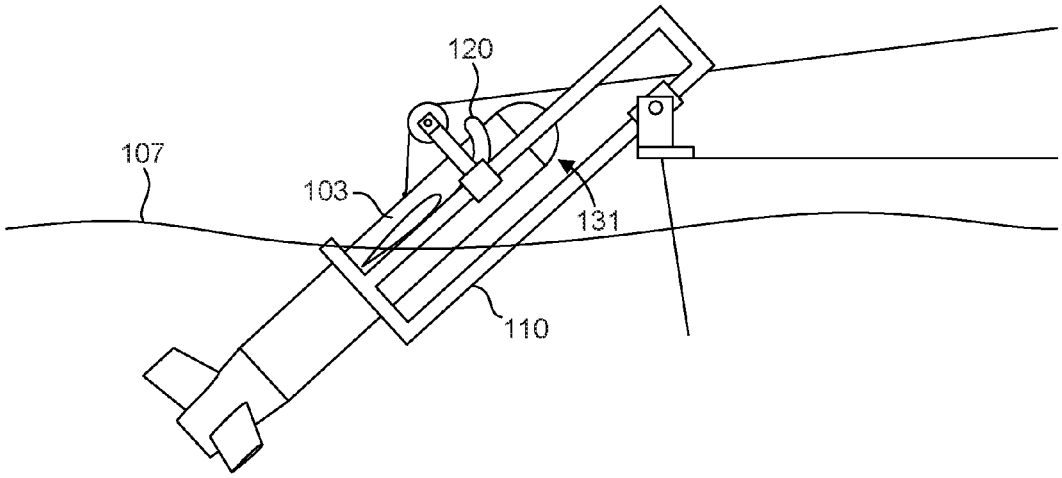

As shown in FIG. 2C, the support structure 110 can then rotate in direction 172 to engage the towed body 103 with the towed body interface structure 120. In this case, the towed body interface structure 120 initially engages a forward end of the wing 130 of the towed body 103, which is in front of the tow point 134. Thus, when the towed body interface structure 120 engages the wing 130, the towed body 103 will tend to go "nose up." The support structure 110 can continue rotating in direction 172, as shown in FIG. 2D, until the towed body interface structure 120 is fully engaged with the towed body 103, as shown in FIG. 2E. In other words, rotation can continue until the towed body interface structure 120 is in contact with the wing 130 and the forward end 131 of the towed body 103. Throughout this rotation of the support structure 110 and subsequent movements of the support structure 110 to the stowed position, the tow line guide 150 can move along the support structure 110 in direction 173, as necessary, to maintain the tow line 104 extending down to the towed body 103 in a substantially vertical orientation, while also preventing interference between the tow line 104 and the towed body 103 and/or the towed body interface structure 120. The points of contact between the towed body interface structure 120 and the wing 130 and the forward end 131 of the towed body 103, as well as the tension in the tow line 104, can serve to stabilize the towed body 103 during the recovery operation.

It should be recognized that, to this point, the engagement of the towed body interface structure 120 with the towed body 103 and the maneuvering of the support structure 110 have occurred with the towed body 103 substantially under the surface 107 of the water, thus taking advantage of the buoyancy of the towed body 103, the towed body interface structure 120, and/or the support structure 110 in order to minimize loads on the towed body deployment and recovery device 101.

Figure 2F:
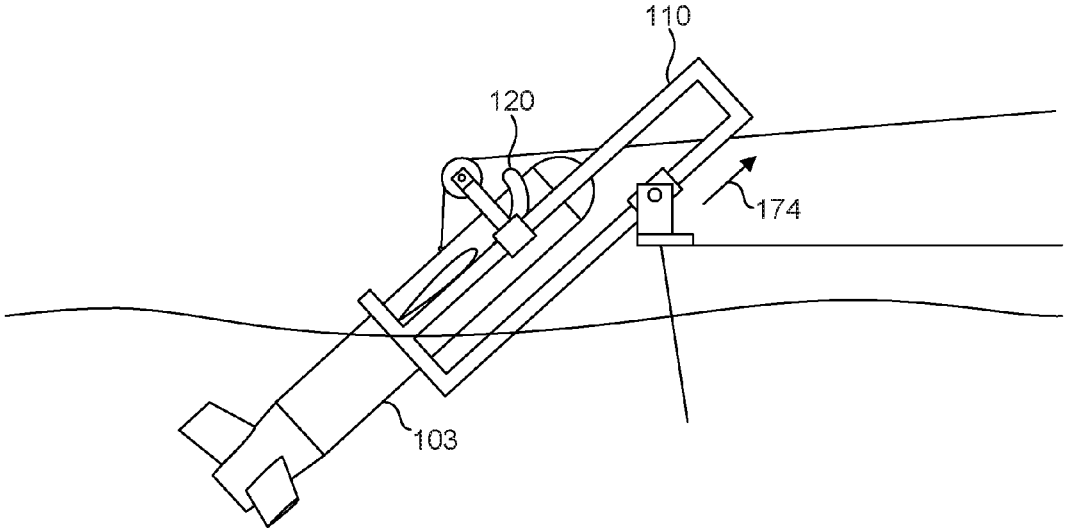
Figure 2G:
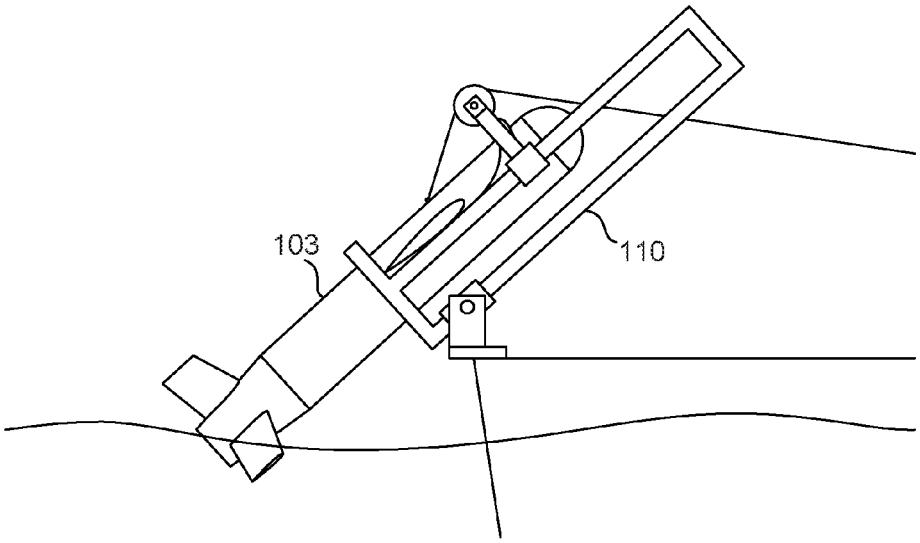
Figure 2H:
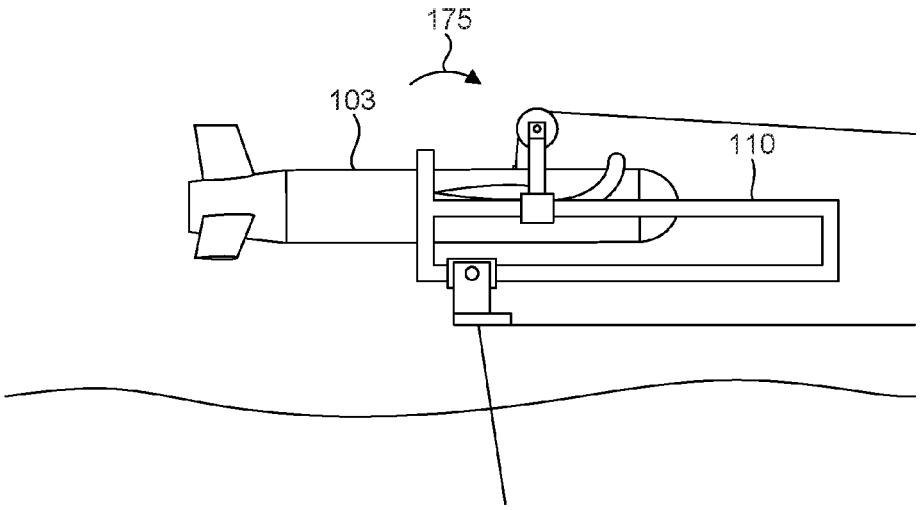

As shown in FIG. 2F, once the towed body interface structure 120 is fully engaged with the towed body 103, the support structure 110 can move in direction 174 until the support structure 110 has reached the end of its travel at the rearward end 115 of the support structure 110, as shown in FIG. 2G. This movement occurs with the towed body 103 at least partially in the water, thus taking further advantage of buoyancy to reduce the weight of the towed body supported by the towed body interface structure 120 under and behind the wing 130. The movement is also in a direction that reduces moment loads on the support structure 110 while raising the towed body 103 from the water. At this point, the support structure 110 can be rotated in direction 175, as shown in FIG. 2H, to the stowed position. Thus, the coordinated sequence of movements of the support structure 110 and/or the tow line guide 150 can minimize loading on the deployment and recovery device 101 when moving between the deploy/recovery position and the stowed position. It should be recognized that the sequence described above can be performed in reverse to execute a deployment operation of the towed body 103.

Figure 3:
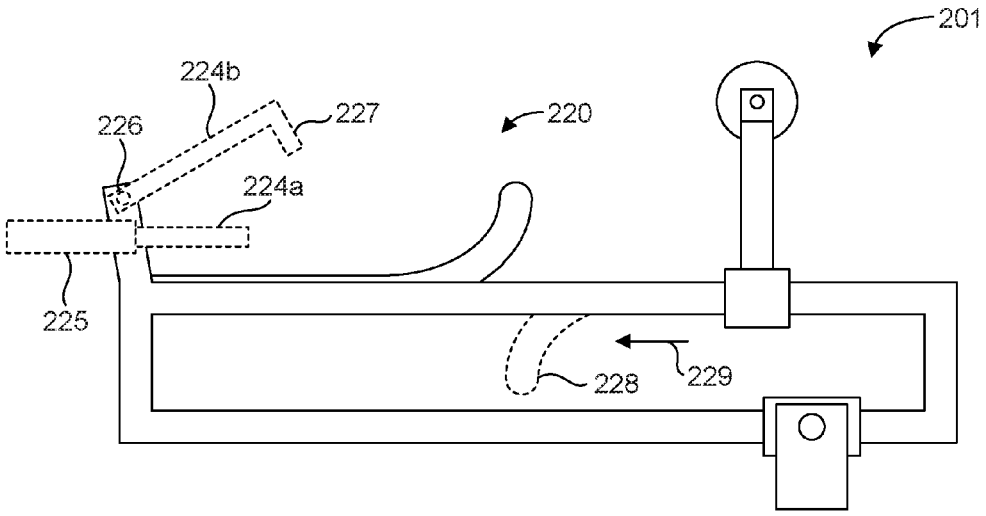
FIG. 3 is an example illustration of a submersible towed body deployment and recovery device, in accordance with an embodiment of the present invention.

FIG. 3 illustrates another example of a deployment and recovery device 201 in accordance with the present disclosure. This embodiment illustrates several features that can be used to stabilize a towed body when in the stowed position. Although the towed body tends to level with the rear of the wing behind the "center" tow point when supported by the towed body interface structure, it can be desirable to include securing restraints or mechanism to hold the forward end or nose of the towed body down, such as when in rough water. Thus, a towed body interface structure 220 can be configured to interface with and support an upper side of the wing. For example, the towed body interface structure 220 can include a wing securing member 224*a*, 224*b* that can be movable into position over the upper side of the wing to support the wing and prevent movement of the wing, such as rocking, that would tend to allow the forward end or nose of the towed body to move. In one aspect, the wing securing member 224*a* is linearly extendable into position, such as by a linear actuator 225. In another aspect, the wing securing member 224*b* is rotatable about a pivot 226, such as by a rotary actuator (not shown). In one aspect, the wing securing member 224*b* can include a catch 227 to limit forward movement of the wing.

The towed body interface structure 220 can also be configured to interface with and support an underside of the forward end or nose of the towed body. For example, the towed body interface structure 220 can include a nose securing member 228 that can be movable into position under the underside of the nose to support the nose and prevent movement of the nose. In one aspect, the nose securing member 228 can be movable by an actuator in direction 229 to secure the nose of the towed body.

Figure 4:
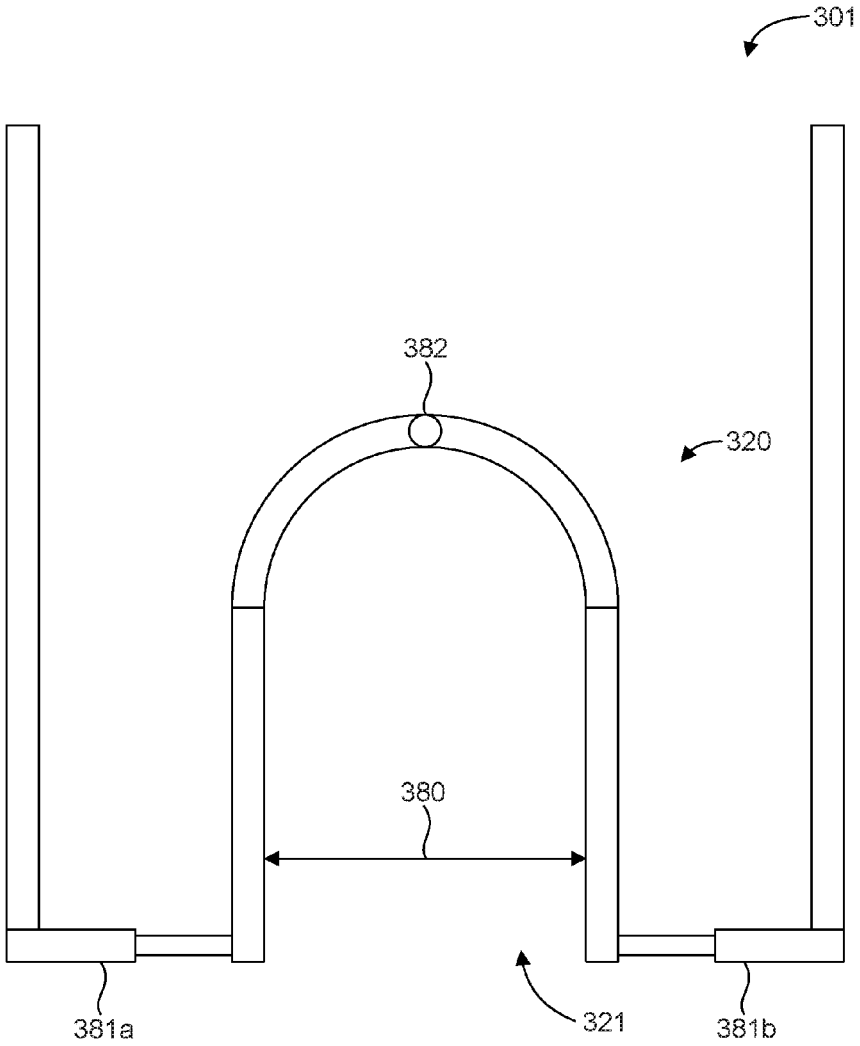
FIG. 4 is a top view of a submersible towed body deployment and recovery device, in accordance with another embodiment of the present invention.

FIG. 4 illustrates yet another example of a deployment and recovery device 301 in accordance with the present disclosure. Some features are omitted for clarity. In this case, the deployment and recovery device 301 has a towed body interface structure 320 that is adjustable to resize the opening 321 to accommodate a range of towed body sizes and/or to adapt to various sea conditions. For example, a width 380 of the opening 321 can be dynamically adjusted, such as when in the water, depending on sea conditions or other considerations. In one aspect, the width 380 can be adjusted by linear actuators 381*a*, 381*b* that can extend or retract to vary the width 380. A hinge 382 can be included to accommodate the relative movement of the linear actuators 381*a*, 381*b*, although, in some embodiments, the towed body interface structure 320 can be configured to flex without a hinge.

Figure 5:
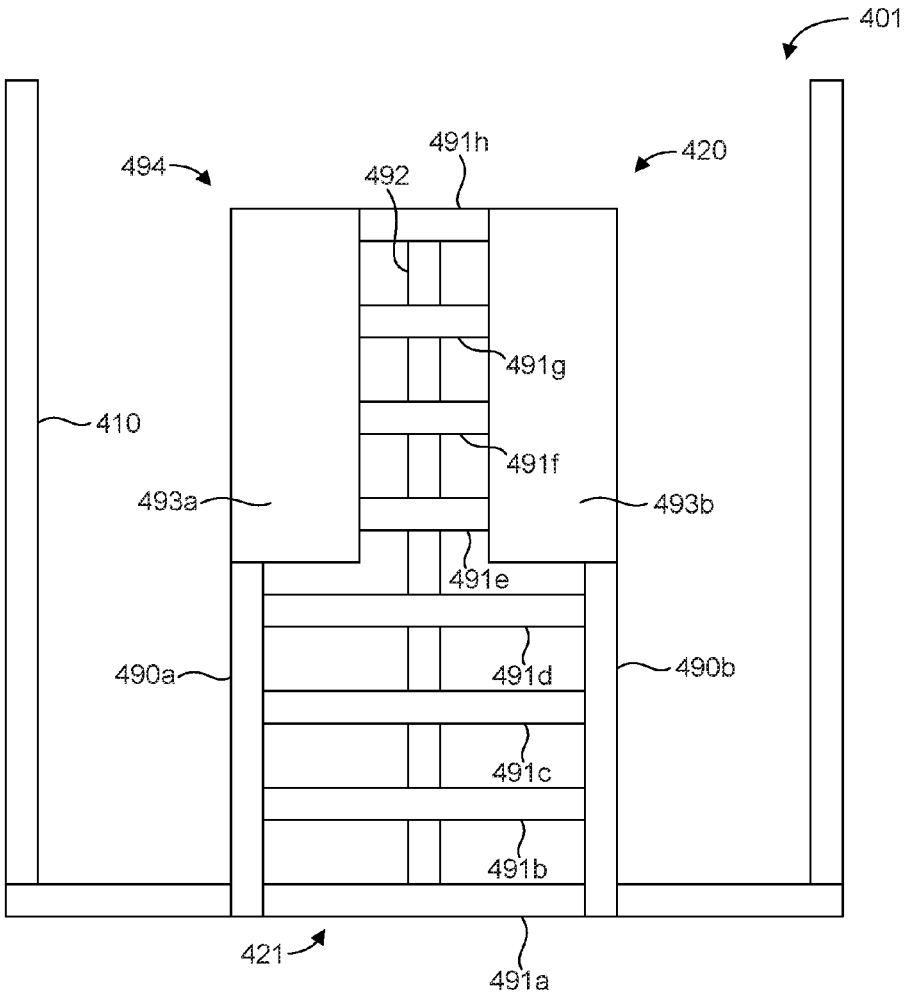
FIG. 5 is a top view of a submersible towed body deployment and recovery device, in accordance with yet another embodiment of the present invention.
Figure 6A:
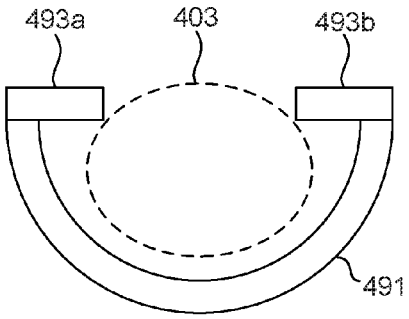
FIG. 6A is a schematic cross-sectional view of a towed body interface structure of the submersible towed body deployment and recovery device of FIG. 5.
Figure 6B:
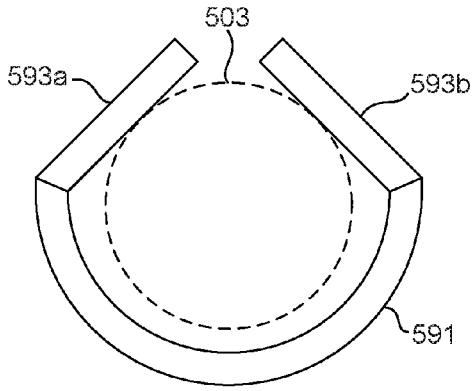
FIG. 6B is a schematic cross-sectional view of a variation of a towed body interface structure of the submersible towed body deployment and recovery device of FIG. 5, in accordance with an embodiment of the present invention.

FIG. 5 illustrates still another example of a deployment and recovery device 401 in accordance with the present disclosure. Some features are omitted for clarity. In this case, the deployment and recovery device 401 has a towed body interface structure 420 that comprises a cage configuration. For example, the towed body interface structure 420 can include lateral members 490*a*, 490*b* with multiple cross members 491*a-h* extending between the lateral members 490*a*, 490*b*. A central support member 492 can be coupled to the cross members 491*a-h* between the lateral members 490*a*, 490*b*. The cross members 491*a-h* can have a curved profile, as shown generically in the schematic illustrations of FIG. 6A. Inwardly extending capture members 493*a*, 493*b* can be disposed at a forward end 494 of the towed body interface structure 420, thus creating an opening 421 to receive a forward end of a towed body. The cross members 491*a-d* can limit movement of the towed body into the cage. Thus, as a support structure 410 is rotated, the nose of the towed body 403 can be captured between the cross members 491*e-h* and the capture members 493*a*, 493*b*, as shown in FIG. 6A. FIG. 6B illustrates a variation of the cage configuration, in that capture members 593*a*, 593*b* extend inwardly and away from the cross members 591 to provide a larger area for the nose of the towed body 503. In one aspect, the capture members 593*a*, 593*b* can be hinged to pivot away from or toward the cross members 591 to accommodate towed bodies of various sizes. As with other embodiments disclosed herein, the various components of a towed body interface structure comprising a cage can be padded to prevent damage to a towed body.

In one embodiment of the present invention, a method for facilitating deployment and recovery of a submersible towed body is disclosed. The method can comprise providing a submersible towed body deployment and recovery device, the device comprising a support structure, and a towed body interface structure supported by the support structure and configured to interface with and support a wing and a forward end of a towed body. Additionally, the method can comprise facilitating use of the submersible towed body deployment and recovery device with a surface watercraft, such that the support structure is supportable by the surface watercraft and configured for rotational and translational movement relative to the watercraft, wherein the support structure is movable between a deploy/recovery position in which at least a portion of the towed body interface structure extends into water about the watercraft and a stowed position in which the towed body interface structure positions the towed body out of the water, and wherein coordinated rotational and translational movement of the support structure utilizes buoyancy of the towed body in the water to minimize loading on the deployment and recovery device when moving between the deploy/recovery position and the stowed position. It is noted that no specific order is required in this method, though generally in one embodiment, these method steps can be carried out sequentially.

In one aspect, the submersible towed body deployment and recovery device can further comprise a tow line guide coupled to and supported by the support structure, wherein the tow line guide is configured to translate relative to the support structure to guide the tow line between the watercraft and the towed body during movement between the deploy/recovery position and the stowed position. In another aspect, the towed body interface structure can include an opening to receive the forward end of the towed body and facilitate movement of the forward end of the towed body into contact with a top support of the towed body interface structure as the wing rotates about a wing support of the towed body interface structure.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A submersible towed body deployment and recovery device, comprising:

a support structure supportable by a surface watercraft, and configured for rotational and translational movement relative to the watercraft; and a towed body interface structure supported by the support structure and configured to interface with and support a portion of a towed body, the support structure being caused to rotate in a first direction to engage the towed body with the towed body interface structure and in a second direction to disengage the towed body from the towed body interface structure, wherein the support structure is movable between a deploy/recovery position in which at least a portion of the towed body interface structure extends into water about the watercraft and a stowed position in which the towed body interface structure positions the towed body out of the water, and wherein coordinated rotational and translational movement of the support structure utilizes buoyancy of the towed body in the water to minimize loading on the deployment and recovery device when moving between the deploy/recovery position and the stowed position.

2. The deployment and recovery device of claim 1, further comprising a tow line guide coupled to and supported by the support structure, wherein the tow line guide is configured to translate relative to the support structure to guide a tow line between the watercraft and the towed body during movement between the deploy/recovery position and the stowed position.

3. The deployment and recovery device of claim 2, wherein the support structure comprises a rail and the tow line guide is translatable relative to the support structure along the rail.

4. The deployment and recovery device of claim 1, wherein the towed body interface structure comprises padding configured to interface with the towed body to minimize damage to the towed body due to contact with the towed body interface structure.

5. The deployment and recovery device of claim 1, wherein the support structure comprises a rail to facilitate translational movement of the support structure relative to the watercraft.

6. The deployment and recovery device of claim 1, wherein an actuated pivotal joint facilitates rotational movement of the support structure relative to the watercraft.

7. The deployment and recovery device of claim 1, wherein an actuated linear joint facilitates translational movement of the support structure relative to the watercraft.

8. The deployment and recovery device of claim 1, wherein the towed body interface structure is configured to interface with and support an underside of a wing and an upper side of a forward end of the towed body.

9. The deployment and recovery device of claim 8, wherein the towed body interface structure is further configured to interface with and support an upper side of the wing.

10. The deployment and recovery device of claim 1, wherein the towed body interface structure comprises a rear extension configured to interface with and support a trailing end of a wing of the towed body.

11. The deployment and recovery device of claim 1, wherein the towed body interface structure includes an opening to receive a forward end of the towed body and facilitate movement of the forward end of the towed body into contact with a top support of the towed body interface structure as a wing rotates about a wing support of the towed body interface structure.

12. The deployment and recovery device of claim 11, wherein the opening is size adjustable to accommodate a range of towed body sizes.

13. The deployment and recovery device of claim 1, wherein the towed body interface structure comprises a cage configuration.

14. A submersible towed body deployment and recovery system, comprising:

a surface watercraft;

a submersible towed body coupled to the watercraft by a tow line; and a towed body deployment and recovery device, including a support structure supported by the watercraft, and configured for rotational and translational movement relative to the watercraft, and a towed body interface structure supported by the support structure and configured to interface with and support a wing and a forward end of the towed body, the support structure being caused to rotate in a first direction to engage the towed body with the towed body interface structure and in a second direction to disengage the towed body from the towed body interface structure, wherein the support structure is movable between a deploy/recovery position in which at least a portion of the towed body interface structure extends into water about the watercraft and a stowed position in which the towed body interface structure positions the towed body out of the water, and wherein coordinated rotational and translational movement of the support structure utilizes buoyancy of the towed body in the water to minimize loading on the deployment and recovery device when moving between the deploy/recovery position and the stowed position.

15. The system of claim 14, wherein the towed body comprises a sonar sensor.

16. The system of claim 14, wherein the watercraft comprises an unmanned surface vehicle (USV).

17. The system of claim 14, wherein the towed body deployment and recovery device further comprises a tow line guide coupled to and supported by the support structure, wherein the tow line guide is configured to translate relative to the support structure to guide the tow line between the watercraft and the towed body during movement between the deploy/recovery position and the stowed position.

18. A method for facilitating deployment and recovery of a submersible towed body, comprising:

providing a submersible towed body deployment and recovery device, the device comprising a support structure, and a towed body interface structure supported by the support structure and configured to interface with and support a wing and a forward end of a towed body; and facilitating use of the submersible towed body deployment and recovery device with a surface watercraft, such that the support structure is supportable by the surface watercraft and configured for rotational and translational movement relative to the watercraft, the support structure being rotatable in a first direction to engage the towed body with the towed body interface structure and in a second direction to disengage the towed body from the towed body interface structure, wherein the support structure is movable between a deploy/recovery position in which at least a portion of the towed body interface structure extends into water about the watercraft and a stowed position in which the towed body interface structure positions the towed body out of the water, and wherein coordinated rotational and translational movement of the support structure utilizes buoyancy of the towed body in the water to minimize loading on the deployment and recovery device when moving between the deploy/recovery position and the stowed position.

19. The method of claim 18, wherein the submersible towed body deployment and recovery device further comprises a tow line guide coupled to and supported by the support structure, wherein the tow line guide is configured to translate relative to the support structure to guide the tow line between the watercraft and the towed body during movement between the deploy/recovery position and the stowed position.

20. The method of claim 18, wherein the towed body interface structure includes an opening to receive the forward end of the towed body and facilitate movement of the forward end of the towed body into contact with a top support of the towed body interface structure as the wing rotates about a wing support of the towed body interface structure.

* * * * *